United States Patent [19]

Cantarella et al.

[11] 4,032,006

[45] June 28, 1977

[54] SHOCK RESISTANT CONTAINER

[75] Inventors: Victor F. Cantarella, Monroe; John G. Smith, Warwick, both of N.Y.

[73] Assignee: International Paper Company, New York, N.Y.

[22] Filed: Oct. 13, 1976

[21] Appl. No.: 731,880

[52] U.S. Cl. ..... 206/45.19; 206/45.31

[51] Int. Cl.[2] ..... B65D 5/50

[58] Field of Search ..... 206/44 R, 45.12, 45.14, 206/45.19, 45.31, 45.34, 491, 521, 525; 229/14 C, 16 D

[56] References Cited

UNITED STATES PATENTS

| | | | |
|---|---|---|---|
| 1,682,838 | 9/1928 | Feigelman | 206/45.14 |
| 2,455,795 | 12/1948 | Murphy | 206/45.14 |
| 3,078,028 | 2/1963 | Skowronski | 206/45.19 X |
| 3,770,116 | 11/1973 | Cote | 206/45.14 |

*Primary Examiner*—Steven E. Lipman
*Attorney, Agent, or Firm*—Richard J. Ancel

[57] ABSTRACT

A shock resistant, generally tubular container for protecting and displaying fragile articles, such as bottles or decanters, is provided. It is constructed from a single blank of rigid material such as corrugated fiberboard. The container comprises a front wall section consisting of first and second front wall panels. First and second shadow panels are hingedly connected to the first and second front wall panels, respectively, and are folded inwardly from the plane of the front wall section towards the back wall section of the container to thereby form an aperture in the front wall section. A pair of oppositely disposed top and bottom wall panels are provided which are hingedly connected along a first pair of opposed outer edges of the front wall section. Each of the top and bottom wall panels includes a tuck flap hingedly connected along a back edge thereof. The tuck flap hinged to the bottom wall panel has a transverse slot therein. A pair of oppositely disposed end wall panels are hingedly connected along a second pair of opposed outer edges of the front wall section. A pair of back wall panels are provided which are hingedly connected along one edge of each of the end wall panels and which overlie the tuck flaps and meet to thereby form a substantially continuous back wall section for the container. Also provided are members for simultaneously locking the container in erected position and supporting the article of merchandise contained therewithin. These members comprise first and second tabs which are in face-to-face contact and are hingedly connected to one corner of each of the back wall panels. Each of the tabs is folded at a right angle to the back wall section and is inserted into the slot formed in the tuck flap of the bottom wall panel.

23 Claims, 6 Drawing Figures

SHOCK RESISTANT CONTAINER

BACKGROUND OF THE INVENTION

This invention relates to improved display packages or containers for fragile articles of merchandise, such as liquid-containing decanters, bottles, and the like, produced from flat blanks of rigid corrugated or chip board. This invention is particularly concerned with providing a shadow box type of container for use in holding and displaying items such as cosmetics, perfumes, hardware, wine, etc., in such a manner that retention of the item is accomplished by the friction between its surface and the surface of the container medium, the spring action of the shadow panels against the surfaces of the item, and the support of the item by tab means hinged to back panels of the container. The tab means simultaneously lock the container in erected position and support the item held therewithin to thereby protect the item from damage caused by shock and vibration.

Currently, some fragile items are packaged in cartons that provide protection by means of an interior liner, often made of a foamed plastic material, wherein the plastic liner is cut out in the shape of the item to be held. The item housed in this plastic liner is then inserted into a standard paperboard carton. Other fragile items which are packaged in paperboard containers require the use of additional panels added to the blank, or inserts which occupy the free space between the container body and the article to be packaged. Both of these aproaches are not totally adequate. The first approach is expensive and adds extra steps in the packaging of the item. The second approach also requires an additional hand operation in the packaging of the finished item.

Packages which display the article of merchandise contained therewithin are well-known in the art. See, for example, U.S. Pat. Nos. 2,700,456; 2,946,433; and 3,576,253. U.S. Pat. No. 3,576,253 also illustrates the common practice of adding inserts to securely hold the article of merchandise. Shock-absorbing paperboard packages are also known. See, in this connection, U.S. Pat. Nos. 3,481,453 and 3,741,380. None of the containers described in these references however, discloses a shadow box type of container, that is constructed from a single blank and that not only provides good visual display of the packaged item, but provides means for simultaneously locking the container in erected position and supporting the article of merchandise contained therewithin in a manner that protects it from damage caused by shock or vibration.

SUMMARY OF THE INVENTION

The present invention provides a shock resistant, generally tubular, shadow box type of container for protecting and displaying fragile articles, such as bottles or decanters. The container is constructed from a single blank of a rigid, conventional material, such as corrugated fiberboard or chip board. The blank is die cut and includes all the scoring and slitting necessary so that the various panels can be folded along longitudinal and transverse score lines to form a shadow frame-type carton. This carton does not require the use of adhesives, although it is preferred that the means for locking the container in erected position be adhesively secured together. After the carton has been assembled and the item has been placed in the carton, the package may be overwrapped by a clear plastic material, as by shrink wrapping, to protect the packaged item from dirt, dust, or other foreign matter. The outer surface of the container may be provided with a finished face for printing and is of sufficient size to lend itself to attractive graphics. In addition, the container of this invention is versatile and can be readily adapted for a variety of articles of merchandise of various sizes and shapes.

Briefly, the container comprises a front wall section consisting of first and second front wall panels. First and second shadow panels are hingedly connected to the first and second front wall panels, respectively, along weakened longitudinal score lines and are folded inwardly from the plane of the front wall section towards the back wall section of the container to thereby form an aperture in the front wall section. A pair of oppositely disposed top and bottom wall panels are provided which are hingedly connected along longitudinal score lines to a first pair of opposed outer edges of the front wall section. Each of the top and bottom wall panels includes a tuck flap hingedly connected along longitudinal score lines at the back edge thereof. The tuck flap hinged to the bottom wall panel has a transverse slot therein. Preferably, the length of this slot is equal to the width of the tuck flap.

A pair of oppositely disposed end wall panels are hingedly connected along a second pair of opposed outer edges of the front wall section. A pair of back wall panels are provided, each of which is hingedly connected along one edge of each of the end wall panels and each of which overlies a tuck flap. The back wall panels meet approximately at the midpoint of the container to thereby form a substantially continuous back wall section.

Also provided are means for simultaneously locking the container in erected position and supporting the article of merchandise contained therewithin. These means comprise first and second tabs which are in face-to-face contact and are hingedly connected to one corner of each of the back wall panels. Each of the tabs is folded at a right angle to the back wall section and is inserted into the slot formed in the tuck flap of the bottom wall panel.

The full nature of the invention will be understood from the accompanying drawings and the following description and claims.

DETAILED DESCRIPTION OF THE INVENTION

Figure 1:
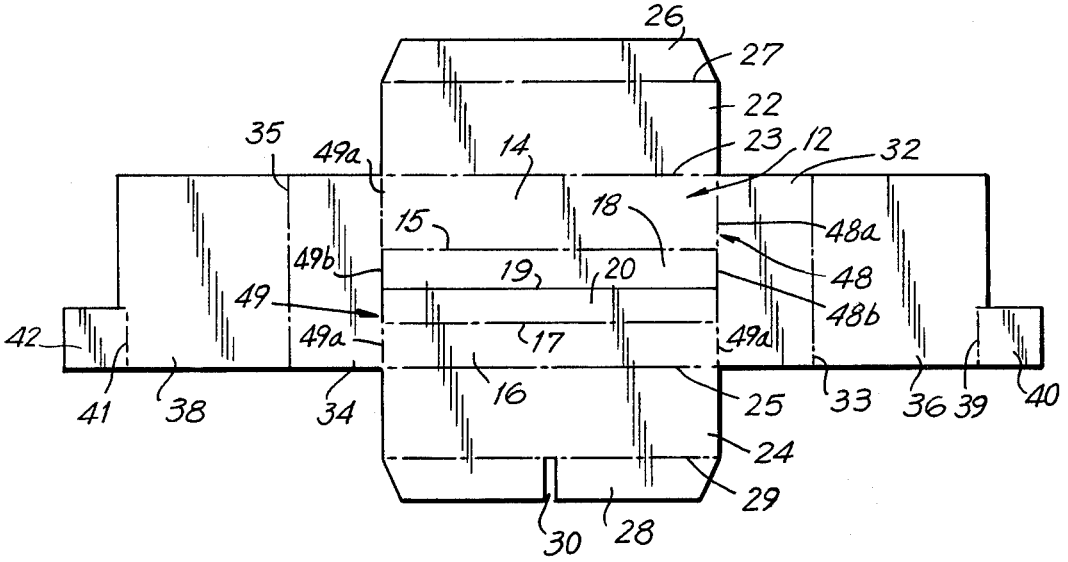
FIG. 1 is a plan view of the inside surface of a cut and scored blank which is used to form the container illustrated in FIG. 2.
Figure 2:
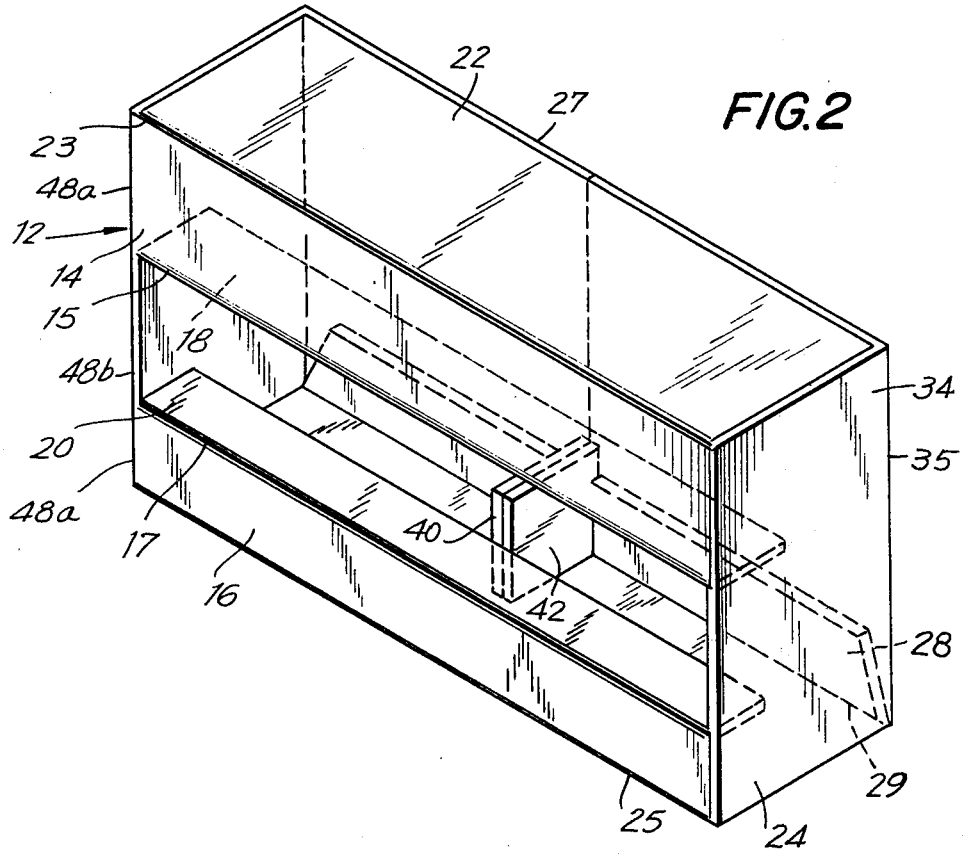
FIG. 2 is a perspective view of one embodiment of a container according to this invention.
Figure 3:
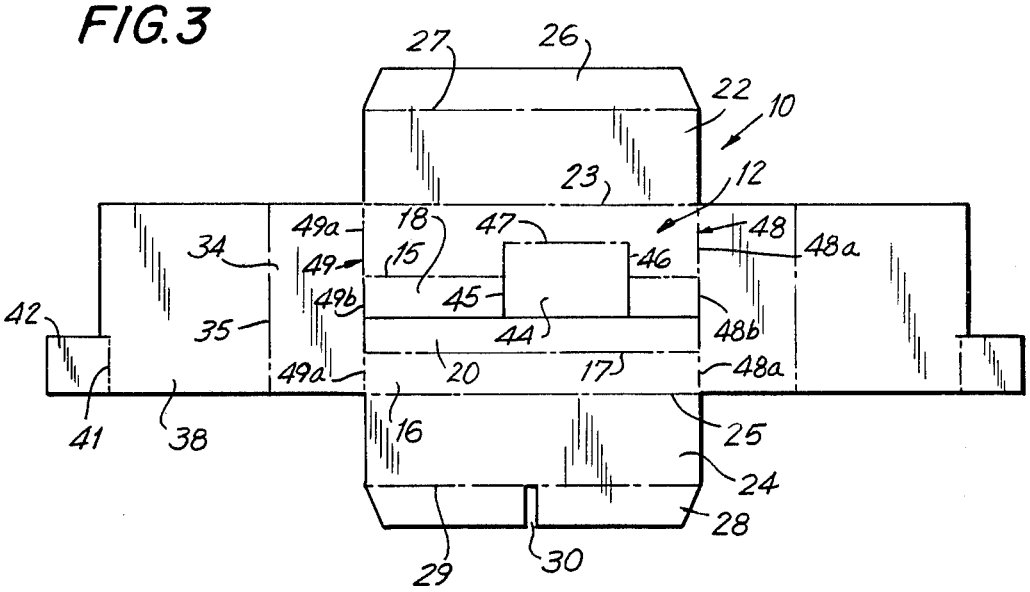
FIG. 3 is a plan view of the inside surface of a cut and scored blank which is used to form an alternate container construction, which is illustrated in FIGS. 4–5.
Figure 4:
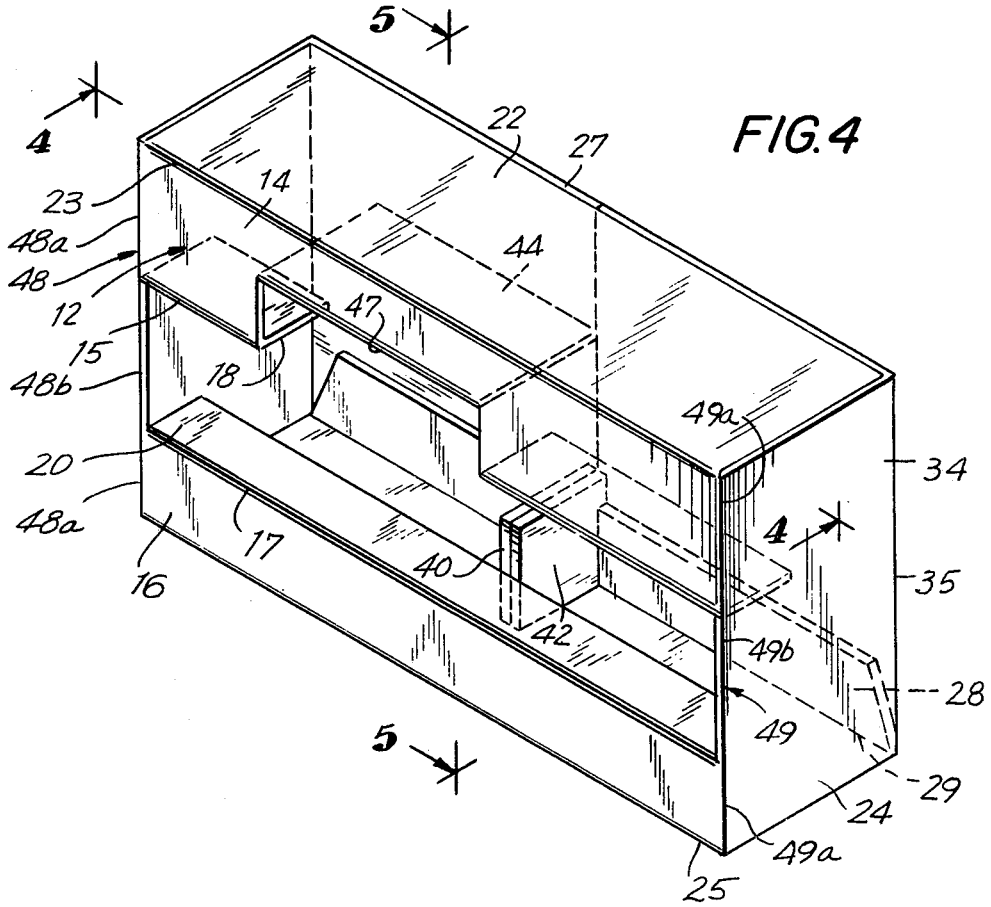
FIG. 4 is a perspective view of an alternate construction of a container of this invention.
Figure 6:
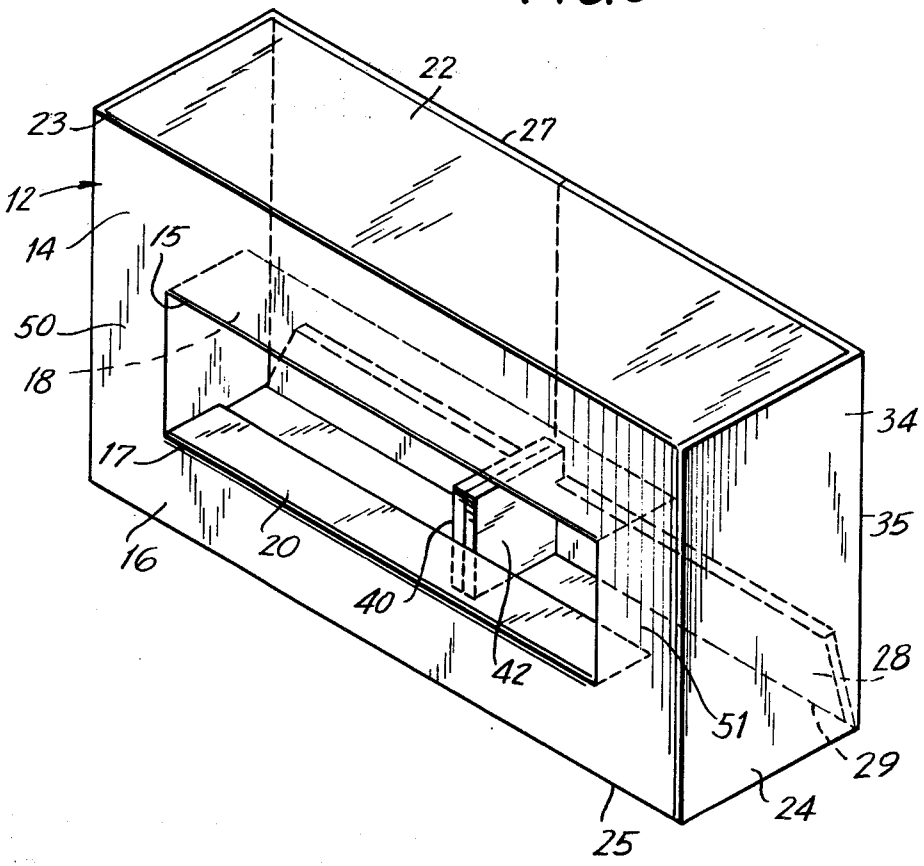
FIG. 6 is a perspective view of a third alternate embodiment of a container of this invention.
Figure 5:
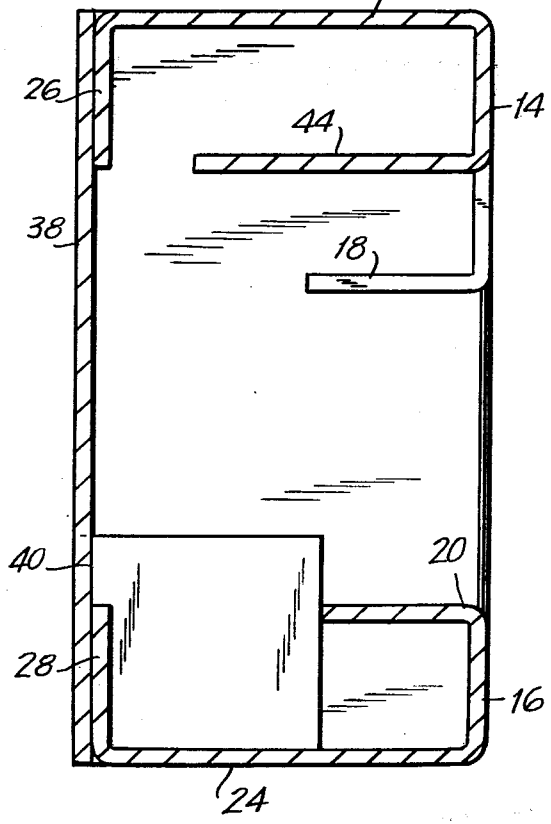
FIG. 5 is a vertical section taken along line 5—5 of FIG. 4.

Referring in more detail to the drawings, wherein the same reference numerals are used to designate like structural elements in the figures throughout, FIGS. 1–2 depict a first preferred embodiment of the invention, FIGS. 3–5 depict another, and FIG. 6 depicts a third preferred embodiment of the invention. The embodiment of FIG. 6 differs primarily from the first and second embodiments in that front wall forming section 12 has vertical sections 50 and 51 which extend vertically along the side of the container at the edges of the open area to aid in holding the fragile item of merchandise in place. The embodiment of FIGS. 3, 4 and 5 differs primarily from the other preferred embodiments in that front wall panel 14 and shadow panel 18 include a flap 44 therein, in order to snugly hold an article of merchandise which is of varying height along its length. An example of such an article of merchandise is a decanter in the shape of an automobile, having a passenger area fitting within the space formed by the inward folding of flap 44, this passenger area being of greater height than the front and rear ends of the auto-shaped decanter.

The embodiment of the invention illustrated in FIGS. 1 and 2 will be referred to primarily in the following description, but the embodiments of FIGS. 3–6 are incorporated as well, since many elements are identical to corresponding elements of FIGS. 1 and 2. Where differences are involved, they will be described separately. Referring to FIG. 1 of the drawings, blank 10 is shown in a generally cruciform outline. It consists of a series of hingedly connected or articulated panels. The view shown is of what will be the inside surface of the erected carton.

Blank 10 comprises generally rectangular front wall forming section 12, which in turn comprises front wall forming panels 14 and 16, which are hingedly connected to shadow forming panels 18, 20 along weakened longitudinal score lines 15, 17, respectively. Preferably, shadow forming panels 18, 20 and front wall forming panels 14, 16 are of equal length. Shadow forming panels 18, 20 are separated from each other by means of longitudinal slit 19. A pair of top and bottom wall forming panels 22, 24, respectively, are hingedly connected to front wall forming section 12 along a first pair of opposing outer edges by longitudinal score lines 23, 25, respectively. First and second tuck flaps 26, 28 are hingedly connected to the top and bottom wall forming panels 22, 24 along score lines 27, 29, respectively. Tuck flap 28 includes a transverse slot 30 therein, placed approximately at the midpoint thereof. It will be appreciated, however, that transverse slot 30 may be placed at most any point along the length of tuck flap 28. A pair of end wall forming panels 32, 34 are hingedly connected to a second pair of opposed outer edges of the front wall forming section 12 along transverse score lines 48, 49, respectively. In order that shadow forming panels 18 and 20 may freely rotate inwardly about score lines 15 and 17, score lines 48 and 49, in the areas designated as 48b, 49b, are completely severed. A pair of black wall forming panels 36, 38 are provided, with each panel being hingedly connected along one edge of each of the end wall forming panels 32, 34, along score lines 33, 35, respectively, which score lines are parallel to transverse score lines 48 and 49. First and second tab means 40, 42 are hingedly connected to one corner of each of the back wall forming panels 36, 38, along transverse score lines 39, 41, respectively, with transverse score lines 39 and 41 being parallel to transverse score lines 33 and 35. Although it is preferred that each of the back wall forming panels 36, 38 be approximately one-half the length of the front wall forming panels 14, 16, it will be appreciated that the back wall forming panels must meet at the point where transverse slot 30 is cut into tuck flap 28, so that tabs 40, 42 may be inserted into the slot 30. As previously noted, slot 30 may be cut into most any area along the length of tuck flap 28.

The embodiment of the container illustrated in FIG. 2 can be erected from the blank shown in FIG. 1 either by hand or machine operation. Machines which can erect these containers are currently available. In erecting the container, a mandrel is located on the inside surface of front wall section 12 and is held there by means of a vacuum. The blank then goes through a form that forces top and bottom panels 22, 24 to rotate upwardly about score lines 23, 25, respectively. At the same time, the form forces end wall panels 32, 34 to rotate inwardly about score lines 48, 49. Back wall panels 36, 38 and tuck flaps 26, 28 are then rotated inwardly about score lines 33, 35, 27, 29, respectively, to thereby close the container. As the side and end walls are rotated inwardly, the mandrel holding front wall section 12 is removed. As the panels are being rotated, tab means 40, 42 are also folded inwardly into a downward position. At the point where tabs 40, 42 come into face-to-face contact, an adhesive material, such as hot melt, or heat set, or cold glue, may be applied to either or both of the tabs. As previously mentioned, the container does not require the use of adhesives, although it is preferred that tab means 40, 42 be adhesively secured together. The rotation then continues until tab means 40, 42 are inserted through transverse slot 30 of tuck flap 28. The liquid containing decanter is then hand or machine loaded through the aperture in the face of the container. It will be noted that the aperture illustrated in FIG. 2 is of proper size and dimension to snugly accommodate the fragile article of merchandise to be displayed (not shown).

As previously mentioned, blank 10 is formed from relatively rigid materials. Suitable materials include, but are not limited to, corrugated fiberboard, or chip board, which is a type of paperboard, SBS (sulfate bleached stock), which is a folding carton grade stock, and corrugated plastic. It has been found that thirty point clay coated chip board is a suitable material for forming these containers. If graphic material has been printed on the outer surface of the container illustrated in FIG. 2, the container can then be overwrapped by means of shrink wrapping, for example, by a clear plastic shroud. If desired, the container illustrated in FIG. 2 may also be slipped into a sleeve of corrugated board or a paperboard box. In the latter instances, the container may be of unbleached corrugated board, since the graphic material would, in all probability, be printed on the outer sleeve or box.

In the blank 10, the exact size and configuration of the various panels and walls are not critical. However, as shown in the drawings, the elements of the blank have a size and configuration adapted to cooperatively provide when erected, a generally tubular container body having interconnected front, back, side and end walls, with an aperture in the face of the container of a size to snugly accommodate a fragile article of merchandise. Although the dimensions of the panels are not critical, it will be appreciated that transverse slot 30 must be cut into tuck flap 28 at the point where back wall panels 36, 38 meet, so that tabs 40, 42 may be inserted through the slot to thereby lock the container in erected position and support the article of merchandise. Tab means 40, 42 are generally at least fiveeighths or three-fourths of the width of bottom panel 24, so that they will not interfere with shadow panel 20 when it is folded inwardly about score line 17 and is perpendicular to the front wall section 12. Depending upon the shape of the article of merchandise, tabs 40, 42 may be of greater or lesser height than the height of front wall panel 16. Shadow panels 18, 20 are separated by means of slit 19, which is generally located midway between score lines 23, 25. It will be appreciated, however, that slit 19 may be located a distance away from this midpoint.

It will be seen, then, that the container retains the article of merchandise in the following ways. First, the aperture in the front wall section is of an appropriate size to snugly accommodate the article. Second, shadow panels 18, 20, which are located at the upper and lower ends of the aperture, provide a spring action against the upper and lower surfaces of the article, respectively, as a result of the longitudinal score lines 15, 17 that separate them from front wall panels 14, 16. In order to provide the greatest possible amount of spring action, the longitudinal score lines 15 and 17 must be in a direction perpendicular to the flutes of the corrugated board used to form the container. Third, there is friction between the surfaces of the shadow panels and the surfaces of the article. In addition, the article is supported not only by the lower shadow panel 20, but by tab means 40, 42 which support its weight.

The container has an attractive appearance, and it may be readily produced in a variety of styles which are in line with the principles of the present invention. These styles, however, may require slight modifications to several of the panels which comprise front wall section 12, as will be described hereinafter.

A modified embodiment of the invention is illustrated in FIGS. 3, 4, and 5 of the drawings. Parts of the blank for making the same which correspond to parts shown in FIGS. 1 and 2 of the drawings will be indicated by use of the same reference numerals. It is the primary object of the modified embodiment shown in FIGS. 3, 4, and 5 to provide a container wherein the aperture in the front wall section is designed to hold the decanter in the shape of an automobile, wherein the passenger area of the auto-shaped decanter is of greater height than its front and rear ends. To this end, an additional shadow panel 44 is formed from front wall panel 14 and shadow panel 18. Panel 44 is defined by transverse severed lines 45 and 46, and weakened longitudinal score line 47. Thus first, second and third shadow panels 18, 18, and 44 are hingedly connected to the first front wall panel 14 and a fourth shadow panel 20 is hingedly connected to the second front wall panel 16. As is clear from FIGS. 5 and 6, when the container is erected, shadow panel 44 will press against the upper surface of the passenger area of the auto-shaped decanter (not shown).

A third embodiment is illustrated in FIG. 6. This embodiment differs from the container illustrated in FIGS. 1 and 2, in that front wall forming section 12 has vertical sections 50 and 51 which extend along the sides of the container at the edges of the aperture to better hold the decanter (not shown) in place. In this embodiment, shadow panels 18, 20 are shorter in length than the front wall panels 14, 16 to which they are hingedly connected.

Generally speaking, from the foregoing description it will be seen that the present invention, in any of the forms illustrated herein, consists of a generally tubular container for protecting and displaying fragile articles, such as bottles or decanters, constructed from a single blank. The container comprises a front wall section consisting of first and second front wall panels. At least first and second shadow panels are hingedly connected to the first and second front wall panels, respectively, and are folded inwardly from the plane of the front wall section towards the back wall section of the container to thereby form an aperture in the front wall section. A pair of oppositely disposed top and bottom wall panels are provided which are hingedly connected along a first pair of opposed outer edges of the front wall section. Each of the top and bottom wall panels includes a tuck flap hingedly connected along a back edge thereof. The tuck flap hinged to the bottom wall panel has a transverse slot therein. A pair of oppositely disposed end wall panels are hingedly connected along a second pair of opposed outer edges of the front wall section. A pair of back wall panels are provided which are hingedly connected along one edge of each of the end wall panels and which overlie the tuck flaps and meet to thereby form a substantially continuous back wall section for the container. Also provided are means for simultaneously locking the container in erected position and supporting the article of merchandise contained therewithin. These means comprise first and second tabs which are in face-to-face contact and are hingedly connected to one corner of each of the back wall panels. Each of the tabs is folded at a right angle to the back wall section and is inserted into the slot formed in the tuck flap of the bottom wall panel.

Although the invention has been described above by reference to a number of illustrative embodiments, it will be appreciated that other container constructions may be devised which are, nevertheless, within the scope and spirit of the invention and are defined by the claims appended hereto.

What is claimed is:

1. A unitary blank for constructing a shock resistant container, said blank comprising:

a front wall-forming section, said front wall-forming section comprising first and second front wall-forming panels, each of said front wall-forming panels having weakened longitudinal score lines, to thereby form, respectively, first and second shadow-forming panels;

top and bottom wall-forming panels hingedly connected along longitudinal score lines to a first pair of opposite edges of said front wall-forming section;

first and second tuck flaps hingedly connected along longitudinal score lines to said top and bottom wall-forming panels respectively, one of said tuck flaps having a transverse slot therein;

a pair of end wall-forming panels hingedly connected along a second pair of opposing outer edges of said front wall-forming section along transverse score lines;

a pair of back wall-forming panels, each hingedly connected along one edge of each of said end wall-forming panels along a score line parallel to said transverse score line, each of said back wall-forming panels being approximately one-half the length of said front wall-forming panels; and first and second tab means hingedly connected along a transverse score line along a portion of the other edge of each of said back wall-forming panels, said transverse score lines being parallel to the transverse score lines at the opposite edges of said back wall-forming panels.

2. A blank according to claim 1 in which said shadow forming panels and said front wall-forming panels are equal in length.

3. A blank according to claim 2 in which said transverse slot length is equal to said tuck flap width.

4. A blank according to claim 1 which is constructed from a material selected from the group consisting of paperboard, fiberboard, and corrugated plastic.

5. The blank according to claim 4 which is constructed from corrugated fiberboard.

6. The blank according to claim 4 which is constructed from chip board.

7. A unitary blank for constructing a shock resistant container, said blank comprising:

a front wall-forming section, said front wall-forming section comprising first and second front wall-forming panels, each of said front wall-forming panels having weakened longitudinal score lines, said first front wall-forming panel having first, second and third shadow forming panels hingedly connected thereto along longitudinal score lines, and said second front wall-forming panel having a fourth shadow forming panel hingedly connected thereto along a longitudinal score line;

top and bottom wall-forming panels hingedly connected along longitudinal score lines to a first pair of opposite edges of said front wall-forming section;

first and second tuck flaps hingedly connected along longitudinal score lines to said top and bottom wall-forming panels respectively, one of said tuck flaps having a transverse slot therein;

a pair of end wall-forming panels hingedly connected along a second pair of opposing outer edges of said front wall-forming section along transverse score lines;

a pair of back wall-forming panels, each hingedly connected along one edge of each of said end wall-forming panels along a score line parallel to said transverse score line, each of said back wall-forming panels being approximately one-half the length of said front wall-forming panels; and first and second tab means hingedly connected along a transverse score line along a portion of the other edge of each of said back wall-forming panels, said transverse score lines being parallel to the transverse score lines at the opposite edges of said back wall-forming panels.

8. A blank according to claim 7 in which said transverse slot length is equal to said tuck flap width.

9. A blank according to claim 7 which is constructed from a material selected from the group consisting of paperboard, fiberboard, and corrugated plastic.

10. A blank according to claim 9 which is constructed from corrugated fiberboard.

11. A blank according to claim 9 which is constructed from chip board.

12. A shock resistant container for holding and displaying a fragile article of merchandise, such as a bottle or a decanter, constructed from a single blank, said container being generally tubular in shape and comprising:

a front wall section consisting of first and second front wall panels;

first and second shadow panels hingedly connected to said first and second front wall panels, respectively, wherein said shadow panels are folded inwardly from the plane of said front wall section to thereby form an aperture in said front wall section;

a pair of oppositely disposed top and bottom wall panels hingedly connected along a first pair of opposing outer edges of said front wall section;

a pair of tuck flaps respectively hingedly connected to said top and bottom wall panels along weakened longitudinal score lines that are parallel to said edges of said front wall section, the tuck flap hinged to said bottom wall panel having a transverse slot therein;

a pair of oppositely disposed end wall panels hingedly connected along a second pair of opposed outer edges of said front wall section;

a pair of back wall panels, each hingedly connected along one edge of each of said end wall panels, said back wall panels overlying said tuck flaps and meeting to thereby form a substantially continuous back wall section for the container; and means for simultaneously locking said container in erected position and supporting the article of merchandise contained therewithin, said means comprising first and second tabs which are in face-to-face contact and are hingedly connected to one corner of each of said back wall panels, each of said tab means being folded at a right angle to said back wall section, each of said tab means being inserted into the slot formed in said tuck flap.

13. A container according to claim 12 in which said shadow panels and said front wall panels are equal in length.

14. A container according to claim 13 in which said transverse slot length is equal to said tuck flap width.

15. A container according to claim 12 which further includes a pair of vertical panels along the edges of the aperture in the front wall section.

16. A container according to claim 12 in which said blank is constructed from a material selected from the group consisting of paperboard, fiberboard and corrugated plastic.

17. A container according to claim 16 in which said blank is constructed from corrugated fiberboard.

18. A container according to claim 16 in which said blank is constructed from chip board.

19. A shock resistant container for holding and displaying a fragile article of merchandise, such as a bottle or a decanter, constructed from a single blank, said container being generally tubular in shape and comprising:

a front wall section consisting of first and second front wall panels;

first, second and third shadow panels hingedly connected to said first front wall panel, and a fourth shadow panel hingedly connected to said second front wall panel, wherein said shadow panels are folded inwardly from the plane of said front wall section to thereby form an aperture in said front wall section;

a pair of oppositely disposed top and bottom wall panels hingedly connected along a first pair of opposing outer edges of said front wall section;

a pair of tuck flaps respectively hingedly connected to said top and bottom wall panels along weakened longitudinal score lines that are parallel to said edges of said front wall section, the tuck flap hinged to said bottom wall panel having a transverse slot therein;

a pair of oppositely disposed end wall panels hingedly connected along a second pair of opposed outer edges of said front wall section;

a pair of back wall panels, each hingedly connected along one edge of each of said end wall panels, said back wall panels overlying said tuck flaps and meeting to thereby form a substantially continuous back wall section for the container; and means for simultaneously locking said container in erected position and supporting the article of merchandise contained therewithin, said means comprising first and second tabs which are in face-to-face contact and are hingedly connected to one corner of each of said back wall panels, each of said tab means being folded at a right angle to said back wall section, each of said tab means being inserted into the slot formed in said tuck flap.

20. A container according to claim 19 in which said transverse slot length is equal to said tuck flap width.

21. A container according to claim 19 in which said blank is constructed from a material selected from the group consisting of paperboard, fiberboard, and corrugated plastic.

22. A container according to claim 21 in which said blank is constructed from corrugated fiberboard.

23. A container according to claim 21 in which said blank is constructed from chip board.

* * * * *